US010780311B1

(12) United States Patent
Gadd

(10) Patent No.: US 10,780,311 B1
(45) Date of Patent: Sep. 22, 2020

(54) LEG TUCK BAR FOR DOORFRAME MOUNTABLE EXERCISE APPARATUS

(71) Applicant: Jacob Larry Gadd, Wahiawa, HI (US)

(72) Inventor: Jacob Larry Gadd, Wahiawa, HI (US)

( * ) Notice: Subject to any disclaimer, the term of this patent is extended or adjusted under 35 U.S.C. 154(b) by 0 days.

(21) Appl. No.: 16/862,273

(22) Filed: Apr. 29, 2020

(51) Int. Cl.

| | |
|---|---|
| ***A63B 21/16*** | (2006.01) |
| ***A63B 1/00*** | (2006.01) |
| ***A63B 21/00*** | (2006.01) |
| ***A63B 23/04*** | (2006.01) |

(52) U.S. Cl.
CPC ..... *A63B 21/1636* (2013.01); *A63B 1/00* (2013.01); *A63B 21/00047* (2013.01); *A63B 21/4035* (2015.10); *A63B 23/0405* (2013.01)

(58) Field of Classification Search
CPC ..... A63B 21/1636; A63B 23/0405; A63B 21/00047; A63B 21/4035; A63B 1/00; A63B 21/16–1663; A63B 23/12–1218
See application file for complete search history.

(56) References Cited

U.S. PATENT DOCUMENTS

| | | | | |
|---|---|---|---|---|
| 2,633,998 | A * | 4/1953 | Derman | A47G 25/08 211/104 |
| 3,874,375 | A * | 4/1975 | Penner | A61H 1/0218 606/241 |
| 4,458,894 | A * | 7/1984 | Dudley | A63B 1/00 482/40 |
| 5,180,350 | A | 1/1993 | Thomas | |
| D348,706 | S | 7/1994 | Harrell | |
| 5,417,628 | A | 5/1995 | Vanderbleek | |
| 6,179,748 | B1 * | 1/2001 | Barr | A63B 1/00 482/38 |
| 6,508,743 | B1 * | 1/2003 | Fortin | A63B 1/00 482/38 |
| D633,156 | S * | 2/2011 | Caswell | A63B 1/00 D21/679 |
| D633,961 | S * | 3/2011 | Loew | D21/679 |
| 8,172,726 | B1 * | 5/2012 | Leier | A63B 1/00 482/23 |
| 8,808,146 | B2 | 8/2014 | Gillespie et al. | |
| 8,992,395 | B2 * | 3/2015 | Orakwusi | A63B 21/1636 482/106 |
| 9,044,629 | B2 * | 6/2015 | Ross | A63B 1/005 |
| 9,044,641 | B2 * | 6/2015 | Velikin | A63B 1/00 |
| 9,079,085 | B2 * | 7/2015 | McBride | A63B 69/0048 |
| 9,114,273 | B2 * | 8/2015 | Kehoe | A63B 21/00047 |
| 9,452,308 | B2 * | 9/2016 | Lentz | A63B 1/00 |
| 9,480,206 | B2 * | 11/2016 | Hendricks | A01G 5/04 |
| 9,616,264 | B2 * | 4/2017 | Velikin | A63B 21/1636 482/40 |

(Continued)

OTHER PUBLICATIONS

Design U.S. Appl. No. 29/733,100, filed Apr. 29, 2020, titled "Doorframe Mountable Exercise Apparatus"; 6 pages.

(Continued)

*Primary Examiner* — Andrew S Lo
(74) *Attorney, Agent, or Firm* — Maschoff Brennan

(57) ABSTRACT

Doorframe mountable exercise apparatus. A doorframe mountable exercise apparatus may include a leg tuck bar configured to be mounted to a doorframe. The leg tuck bar may be configured to run approximately perpendicular to a head of the doorframe. The leg tuck bar may be configured to be approximately centrally located between jambs of the doorframe.

20 Claims, 16 Drawing Sheets

(56) References Cited

U.S. PATENT DOCUMENTS

| | | | | |
|---|---|---|---|---|
| 10,376,727 | B2 * | 8/2019 | Fitzpatrick | A61H 1/0218 606/241 |
| 2005/0250619 | A1 | 11/2005 | Daikeler et al. | |
| 2012/0046150 | A1 * | 2/2012 | Stacey | A63B 21/00047 482/131 |
| 2012/0115684 | A1 | 5/2012 | Nguyen | |
| 2012/0129658 | A1 * | 5/2012 | Hunt | A63B 21/068 482/38 |
| 2012/0295766 | A1 * | 11/2012 | Nelson | A63B 21/1636 482/40 |
| 2015/0148197 | A1 * | 5/2015 | Lentz | A63B 21/1618 482/40 |
| 2015/0258359 | A1 * | 9/2015 | Velikin | A63B 1/00 482/40 |

OTHER PUBLICATIONS

ACFT IOC; "Army Combat Fitness Test: Initial Operation Capability"; white paper; Oct. 2019; located at: https://www.army.mil/e2/downloads/rv7/acft/acft_ioc.pdf; accessed on Apr. 30, 2020; 91 pages.

Ultimate Body Press; New—Elevated Doorway Pull Up Bar; Website; located at https://www.ultimatebodypress.com/plb-xl-elevated-doorway-pull-up-bar.html; 2020; 2 pages.

* cited by examiner

LEG TUCK BAR FOR DOORFRAME MOUNTABLE EXERCISE APPARATUS

BACKGROUND

As society continues to realize the importance of daily exercise in order to remain healthy, the need for improved and widely accessible exercise equipment continues to grow. Because of the large number of muscles (and different muscle groups) that are worked in performing pull-ups (with an overhand grip) and chin-ups (with an underhand grip), pull-ups and chin-ups have long been recognized as valuable exercises in maintaining and developing muscle strength, reducing body fat, and shaping the body. However, performing pull-ups and chin-ups often requires expensive and sizable exercise structures that take up a significant amount of space. While most gyms provide free-standing exercise structures having the necessary bar and space to allow a user to perform pull-ups and chin-ups, it can be inconvenient and expensive for some users to regularly visit a gym in order to perform chin-ups and pull-ups.

The subject matter claimed herein is not limited to embodiments that solve any disadvantages or that operate only in environments such as those described above. Rather, this background is only provided to illustrate one example technology area where some embodiments described herein may be practiced.

SUMMARY

In one aspect of the disclosure, a doorframe mountable exercise apparatus may include a leg tuck bar configured to be mounted to a doorframe. The leg tuck bar may be configured to run approximately perpendicular to a head of the doorframe. The leg tuck bar may be configured to be approximately centrally located between jambs of the doorframe.

Another aspect of the disclosure may include any combination of the above-mentioned features and may further include a main bar configured to be mounted to the doorframe and to run approximately parallel to the head of the doorframe, with the leg tuck bar further configured to attach to the main bar at a first attachment location that is approximately centrally located between the jambs of the doorframe.

Another aspect of the disclosure may include any combination of the above-mentioned features and may further include the main bar including first and second hand grip locations, and the leg tuck bar being configured to be approximately centrally located between the first and second hand grip locations.

Another aspect of the disclosure may include any combination of the above-mentioned features and may further include the leg tuck bar including first and second leg hand grip locations located on either side of the first attachment location.

Another aspect of the disclosure may include any combination of the above-mentioned features and may further include the leg tuck bar including first and second hand grip locations both located to one side of the first attachment location.

Another aspect of the disclosure may include any combination of the above-mentioned features and may further include a head plate configured to be positioned above the head of the doorframe, and first and second support bars configured to attach to the head plate and to the main bar in order to connect the head plate to the main bar by running underneath the head of the doorframe and between the jambs of the doorframe.

Another aspect of the disclosure may include any combination of the above-mentioned features and may further include the leg tuck bar being further configured to attach to the head plate in order to connect the head plate to the main bar by running underneath the head of the doorframe and between the jambs of the doorframe.

Another aspect of the disclosure may include any combination of the above-mentioned features and may further include the leg tuck bar including first and second hand grip locations located on either side of the first attachment location.

Another aspect of the disclosure may include any combination of the above-mentioned features and may further include the leg tuck bar including first and second hand grip locations both located to one side of the first attachment location.

Another aspect of the disclosure may include any combination of the above-mentioned features and may further include the first support bar being configured to attach to the head plate at a second attachment location, the first support bar including a first hand grip location, the first support bar being configured to attach to the main bar at a third attachment location that is located between the second attachment location and the first hand grip location, the second support bar being configured to attach to the head plate at a fourth attachment location, the second support bar including a second hand grip location, and the second support bar being configured to attach to the main bar at a fifth attachment location that is located between the fourth attachment location and the second hand grip location.

Another aspect of the disclosure may include any combination of the above-mentioned features and may further include the leg tuck bar including third and fourth hand grip locations located on either side of the first attachment location.

Another aspect of the disclosure may include any combination of the above-mentioned features and may further include the leg tuck bar including third and fourth hand grip locations both located to one side of the first attachment location.

Another aspect of the disclosure may include any combination of the above-mentioned features and may further include the main bar being configured to be positioned above the head of the doorframe.

Another aspect of the disclosure may include any combination of the above-mentioned features and may further include the main bar being configured to be positioned below the head of the doorframe.

Another aspect of the disclosure may include any combination of the above-mentioned features and may further include the leg tuck bar including first and second hand grip locations both located above the main bar.

Another aspect of the disclosure may include any combination of the above-mentioned features and may further include the leg tuck bar including first and second hand grip locations both located below the main bar.

Another aspect of the disclosure may include any combination of the above-mentioned features and may further include the leg tuck bar including first and second hand grip locations both located level with the main bar.

Another aspect of the disclosure may include any combination of the above-mentioned features and may further include the leg tuck bar being further configured to be manually attached to and manually detached from the main bar at the first attachment location without using any tool.

Another aspect of the disclosure may include any combination of the above-mentioned features and may further include the leg tuck bar being further configured to be employed in performing a leg tuck exercise in a doorway of the doorframe without the jambs of the doorframe impeding the performance of the leg tuck exercise.

Another aspect of the disclosure may include any combination of the above-mentioned features and may further include the horizontal distance between the jambs of the doorframe being between 24 and 32 inches.

It is to be understood that both the foregoing summary and the following detailed description are explanatory and are not restrictive of the invention as claimed.

BRIEF DESCRIPTION OF THE DRAWINGS

Embodiments will be described and explained with additional specificity and detail through the use of the accompanying drawings in which.

Throughout the drawings, identical reference numbers designate similar, but not necessarily identical, elements.

DETAILED DESCRIPTION

Pull-ups and chin-ups have long been recognized as valuable exercises. However, performing pull-ups and chin-ups often requires expensive and sizable exercise structures that take up a significant amount of space. Such structures are often cost and size prohibitive for users to have in their homes. While most gyms provide free-standing exercise structures having the necessary bar and space to allow a user to perform pull-ups and chin-ups, it can be inconvenient and expensive for some users to regularly visit a gym in order to perform pull-ups and chin-ups.

Figure 1:
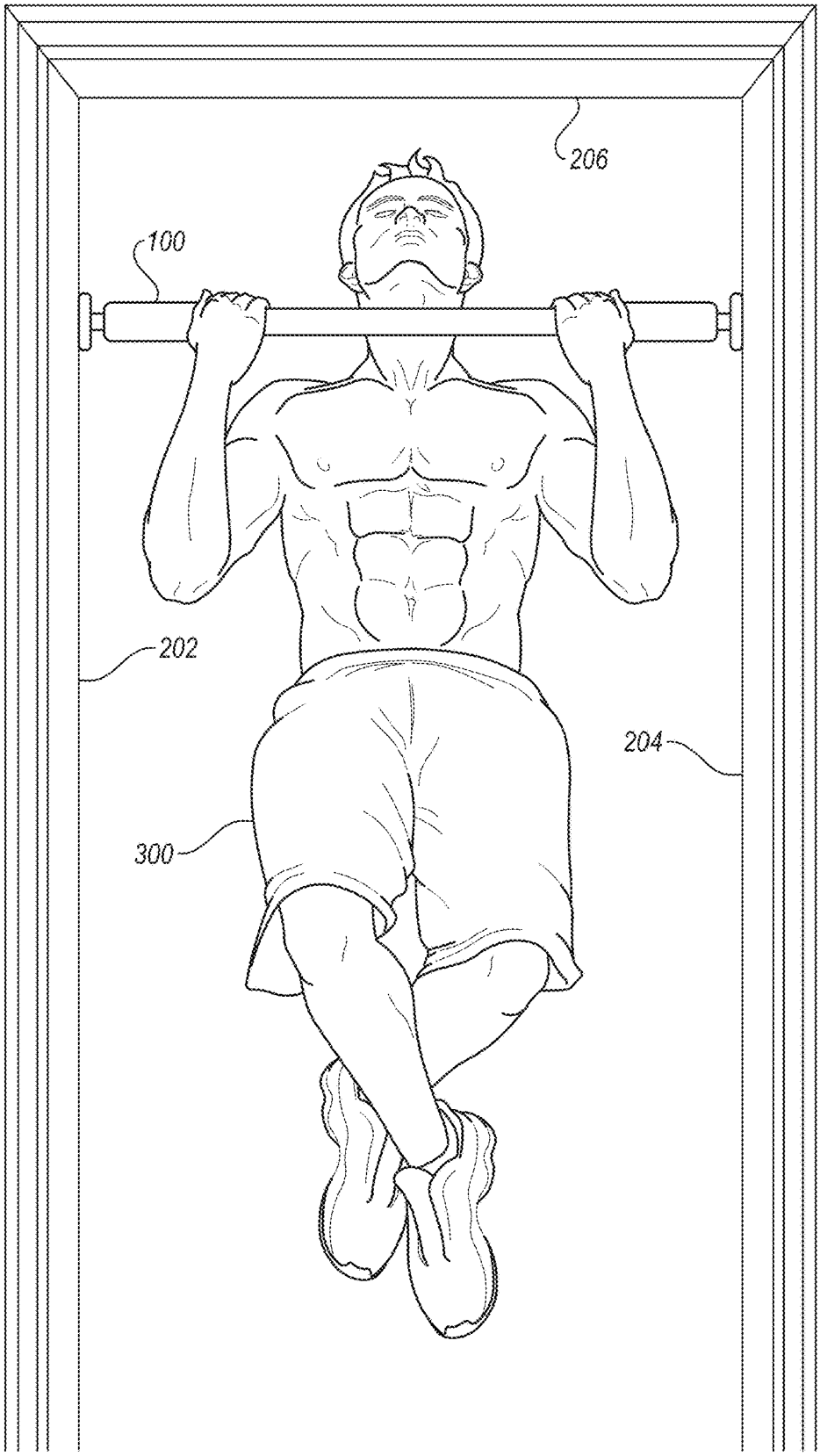
FIG. 1 illustrates a standard doorframe mountable exercise bar.

One alternative to the expensive and sizable exercise structures found in gyms, that still allow a user to perform pull-ups and chin-ups, is a standard doorframe mountable exercise bar. FIG. 1 illustrates a standard doorframe mountable exercise bar 100. As disclosed in FIG. 1, a standard doorframe mountable exercise bar 100 typically mounts on a standard interior doorframe 200 of a home. The standard interior doorframe 200 of a home generally includes two jambs 202 and 204 running vertically with a head 206 running horizontally. The standard interior doorframe 200 may generally have a relatively narrow width between the two jambs 202 and 204, such as 24 inches, 28 inches, 30 inches, or 32 inches, along with a height of head 206 of around 80 inches. The standard doorframe mountable exercise bar 100 is generally designed to have the bar run approximately parallel with the head 206 of the doorframe 200. When performing a pull-up or a chin-up on the doorframe mountable exercise bar of FIG. 1, the door (not shown) of the doorframe 200 may be either removed or swung open, which may allow the user 300 to generally occupy the empty space (e.g., the doorway) of the doorframe 200 (e.g., the space beneath the head 206 and between the jambs 202 and 204 of the doorframe 200) while performing the chin-up illustrated in FIG. 1. More particularly, the user 300 may perform the chin-up illustrated in FIG. 1 by positioning their body approximately parallel to the bar 100, grasping the bar 100 with both hands, and then lifting themself off the ground. As long as the user 300 is generally positioned in the center of the doorway of the doorframe 200 with their body approximately parallel to the bar 100, the user 300 can freely swing their arms, legs, torso, and head through the doorway without coming into contact with jambs 202 and 204 the doorframe 200. In this manner, the doorframe 200 does not impede the performance of the chin-up illustrated in FIG. 1.

Figure 2A:
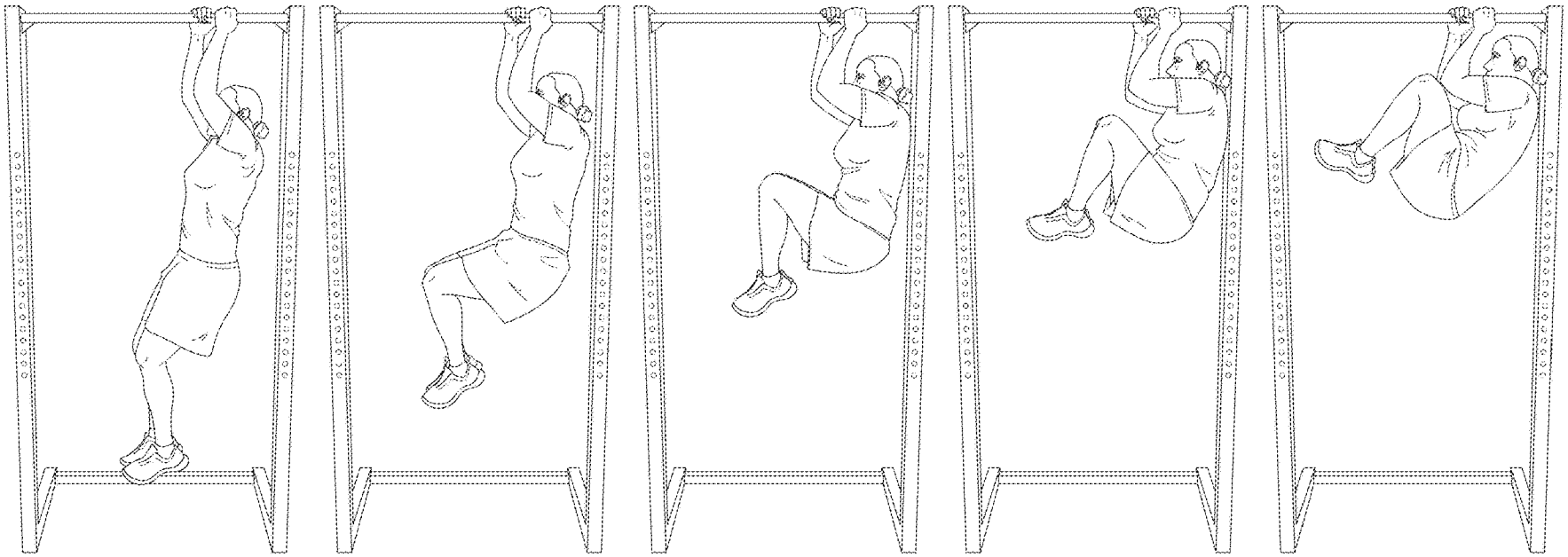
FIGS. 2A-2B illustrate performance of a leg tuck exercise.
Figure 2B:
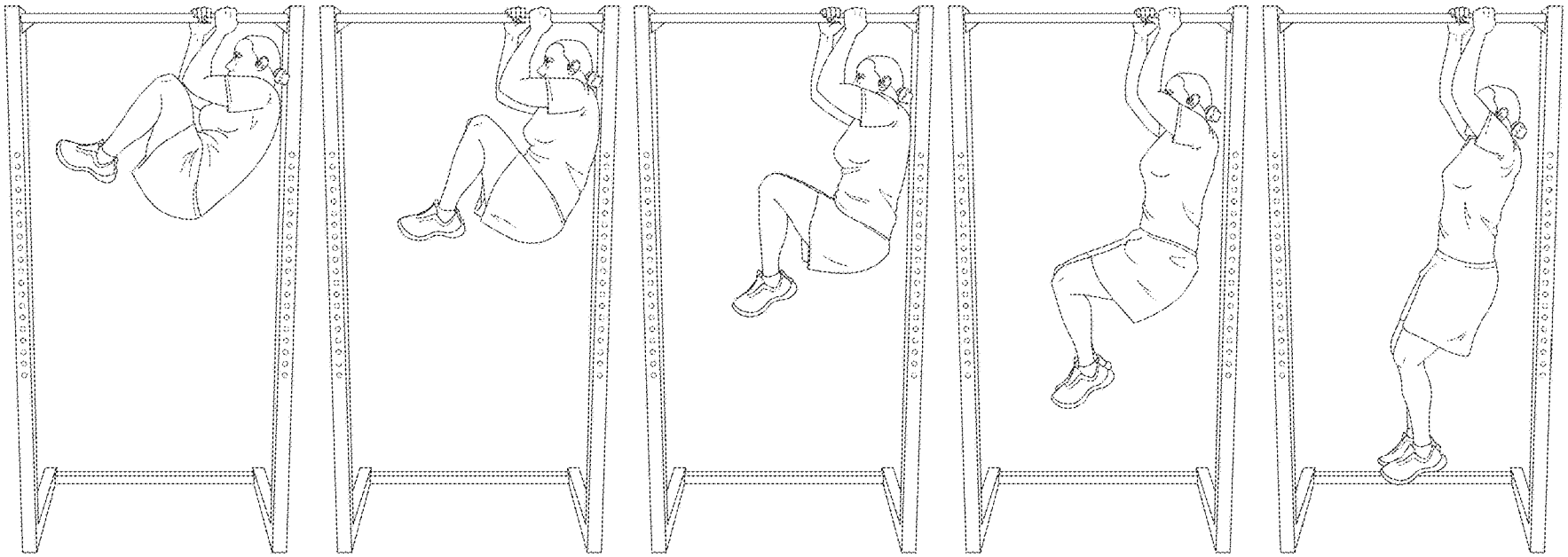

While pull-ups and chin-ups are generally performed with a user grasping a bar with their body positioned approximately parallel to the bar (as disclosed in FIG. 1), some related exercises require a user to grasp a bar with their body positioned approximately perpendicular to the bar. One such exercise is the leg tuck exercise. FIGS. 2A-2B illustrate performance of a leg tuck exercise. The leg tuck exercise will likely soon be required of all U.S. Army soldiers, as outlined in the Army Combat Fitness Test manual (October 2019 version, available online at https://www.army.mil/e2/downloads/rv7/acft/acft_ioc.pdf). Prior to performing the leg tuck exercise, the user positions their body approximately perpendicular to the bar and grasps the bar with both hands. As disclosed in FIG. 2A, the upward movement of the leg tuck exercise then includes the user flexing at their elbows, knees, hips, and waist and lifting their knees up until their right and left knees or front of their thighs touch their right and left elbows, respectively. As disclosed in FIG. 2B, the downward movement of the leg tuck exercise includes the user lowering their legs and straightening their elbows, although the knees may remain bent to avoid the user's feet from touching the floor. The upward and downward movements constituted a single leg tuck exercise. The upward and downward movements are then repeated until the user can no longer hang from the bar.

Figure 3:
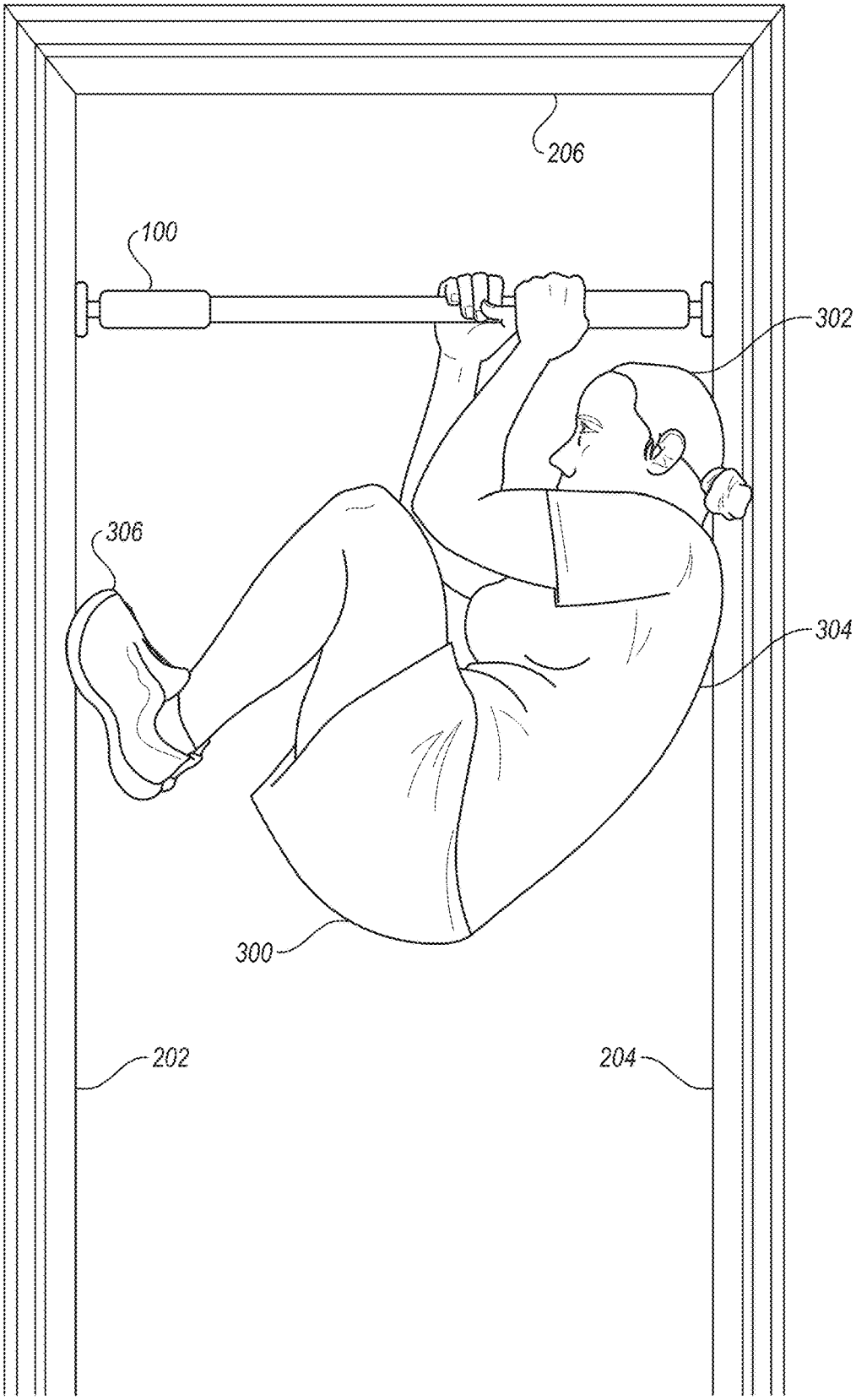
FIG. 3 illustrates jambs of a doorframe impeding the performance of a leg tuck exercise performed on the standard doorframe mountable exercise bar of FIG. 1.

Unfortunately, leg tuck exercises cannot generally be performed using a standard doorframe mountable exercise bar because a standard interior doorframe of a home is not wide enough to allow a user to perform a leg tuck exercise without the doorframe impeding the performance of the leg-tuck. FIG. 3 illustrates the jambs 202 and 204 of the doorframe 200 impeding the performance of a leg tuck exercise performed on the standard doorframe mountable exercise bar 100 of FIG. 1. In particular, as disclosed in FIG. 3, if the user 300 were to attempt to complete the upward movement of the leg tuck exercise using the standard doorframe mountable exercise bar 100 mounted in the standard interior doorframe 200 of a home, the relatively narrow width between the jambs 202 and 204 of the standard interior doorframe 200 (e.g., a width of only 24 inches, 28 inches, 30 inches, or 32 inches) would cause the head 302 and/or upper back 304 and/or feet 306 of the user 300 to come into contact with one or both jambs 202 and 204 of the doorframe 200, which would impede the performance of the leg tuck exercise.

Thus, a user wishing to perform leg tuck exercises is generally unable to do so at home using a standard doorframe mountable exercise bar mounted in a standard interior doorframe of a home due to the relatively narrow width of the doorframe. Therefore, the user wishing to perform leg tuck exercises is faced with purchasing expensive and sizable exercise structures that take up a significant amount of space in their home, or is faced with the inconvenience and expense of regularly visiting a gym to use the gym's equipment.

Some embodiments disclosed herein include a leg tuck bar for a doorframe mountable exercise apparatus. Unlike standard doorframe mountable exercise bars that generally have a bar that runs approximately parallel to a head a doorframe, the leg tuck bars disclosed herein are configured to be mounted approximately in the center of a doorframe (e.g. approximately centered between the two jambs of the doorframe) to run approximately perpendicular to the head of the doorframe. By running approximately perpendicular to the head of the doorframe, the leg tuck bars disclosed herein enable users to perform leg tuck exercises in the relatively narrow doorway of a standard interior doorframe of a home without the relatively narrow doorframe impeding the performance of the leg-tuck, or other similar exercise. In particular, using the leg tuck bars disclosed herein, the user is positioned approximately in the center of the doorway with their body approximately parallel to the doorway, which allows the user to freely swing their arms, legs, torso, and head through the doorway without coming into contact with one or both jambs of the doorframe, thus avoiding any impediment to the performance of the leg tuck exercise, or other similar exercise.

Thus, using any of the leg tuck bars disclosed herein, a user may be able to perform leg tuck exercises in a relatively narrow doorway of a standard interior doorframe of their home. Therefore, any of the leg tuck bars disclosed herein may allow a user to perform leg tuck exercises without purchasing expensive and sizable exercise structures that take up a significant amount of space in their home, and without the inconvenience and expense of regularly visiting a gym to use the gym's equipment.

Figure 4A:
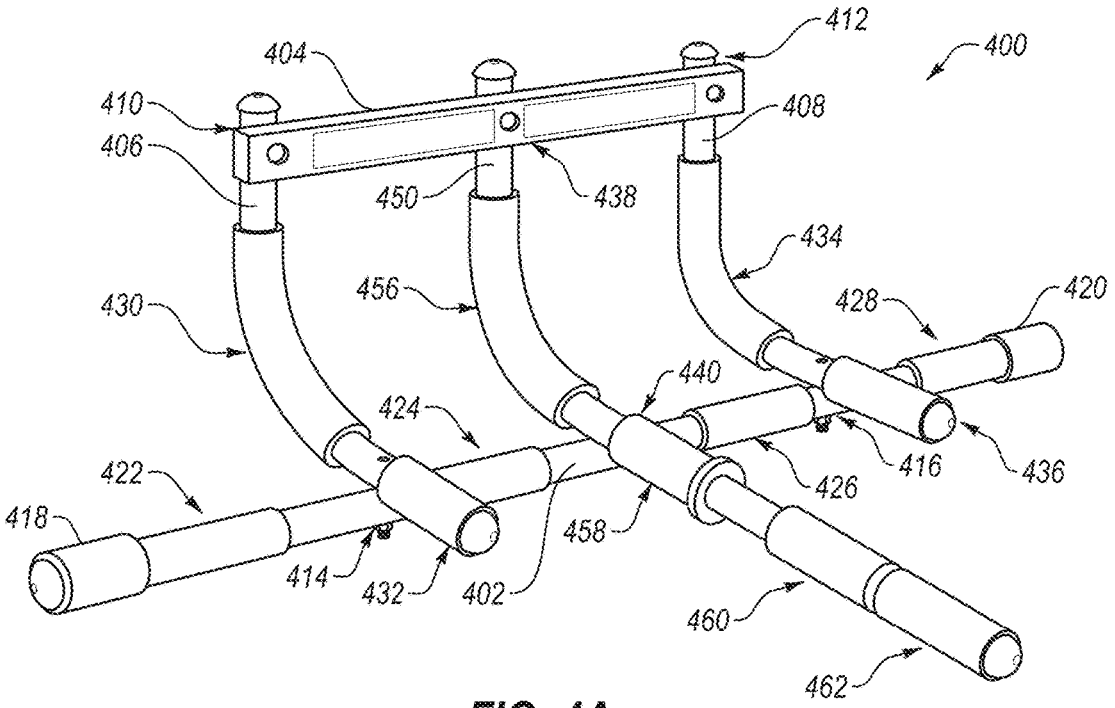
FIG. 4A illustrates a perspective view of a first doorframe mountable exercise apparatus having a leg tuck bar.
Figure 4B:
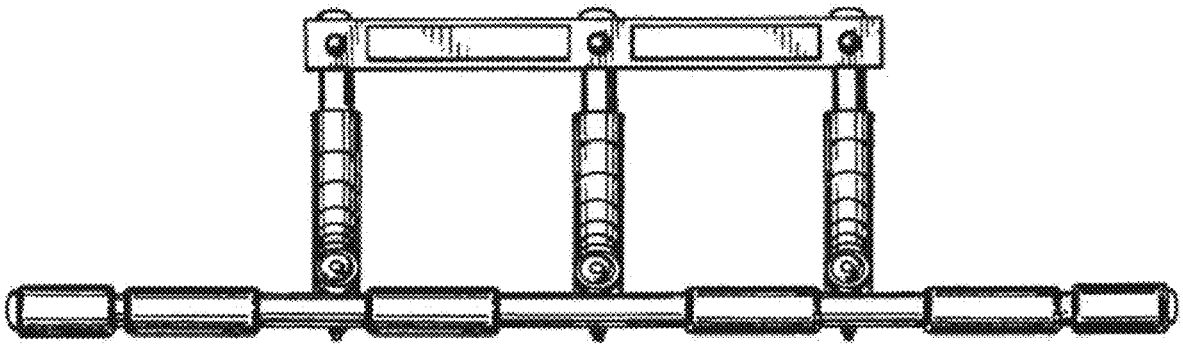
FIG. 4B is a front elevational view of the first doorframe mountable exercise apparatus having a leg tuck bar of FIG. 4A.
Figure 4C:
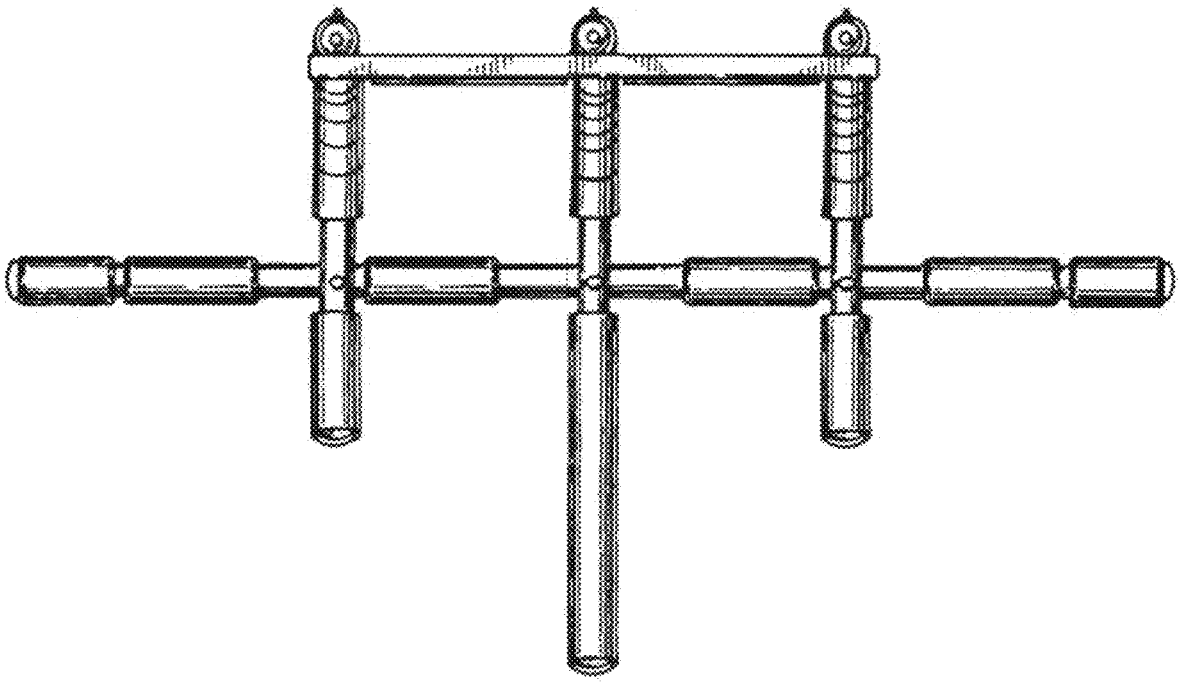
FIG. 4C is a top plan view of the first doorframe mountable exercise apparatus having a leg tuck bar of FIG. 4A.
Figure 4D:
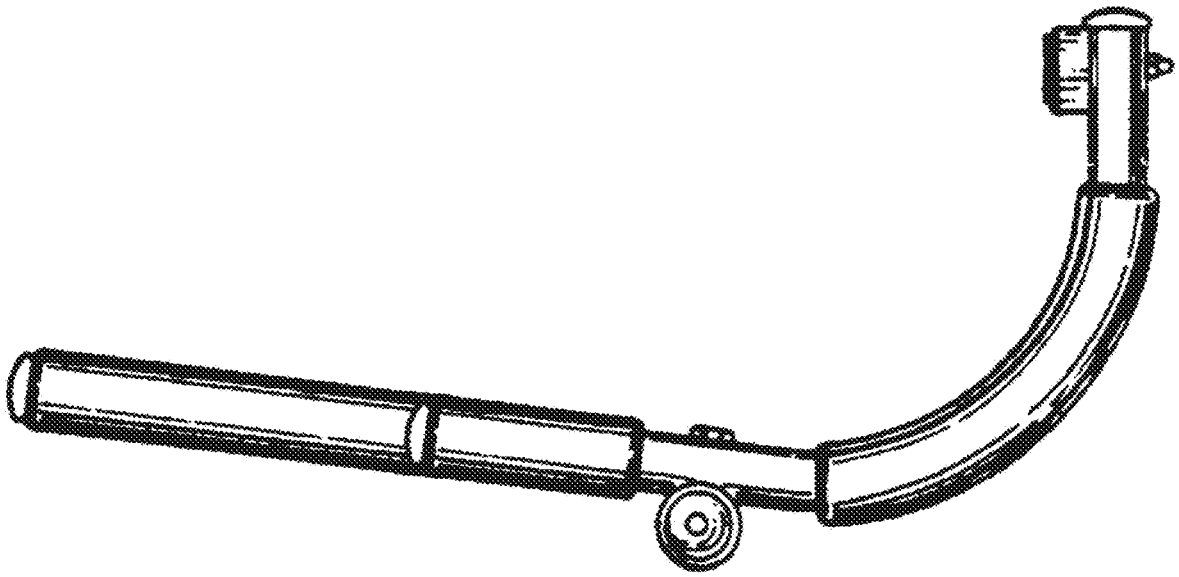
FIG. 4D is a right side elevational view of the first doorframe mountable exercise apparatus having a leg tuck bar of FIG. 4A.
Figure 4E:
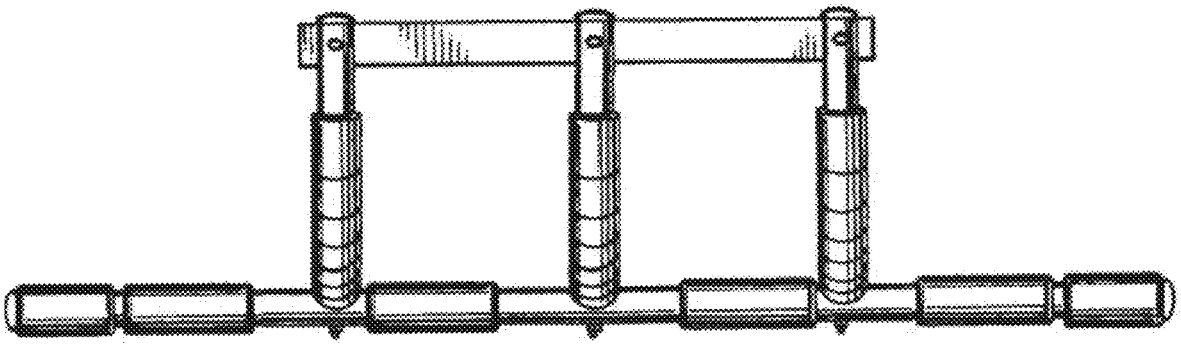
FIG. 4E is a rear elevational view of the first doorframe mountable exercise apparatus having a leg tuck bar of FIG. 4A.
Figure 4F:
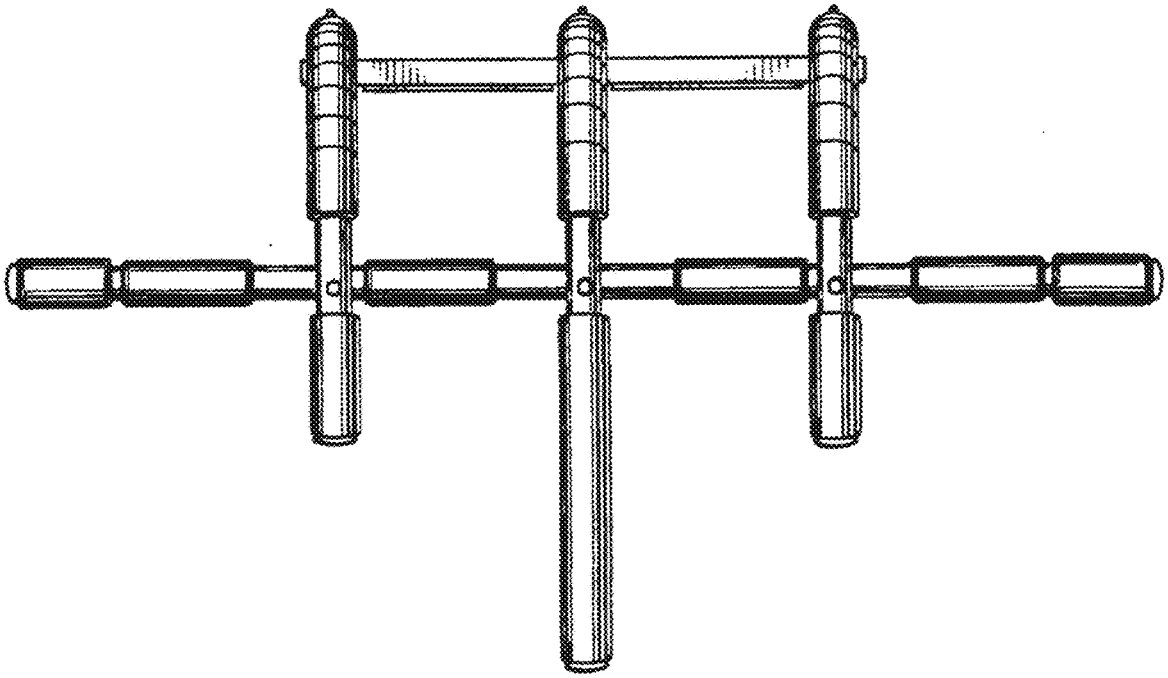
FIG. 4F is a bottom plan view of the first doorframe mountable exercise apparatus having a leg tuck bar of FIG. 4A.

FIG. 4A illustrates a perspective view of a first doorframe mountable exercise apparatus 400 having a leg tuck bar 450. FIGS. 4B-4F are a front elevational view, a top plan view, a right side elevational view, a rear elevational view, and a bottom plan view of the first doorframe mountable exercise apparatus 400 having the leg tuck bar 450. The apparatus 400 may be configured to be mounted in a standard interior doorframe of a home, such as the doorframe 200 disclosed in FIGS. 1 and 3. In some embodiments, the apparatus 400 may be configured to be mounted in a standard interior doorframe (e.g., the doorframe 200) of a home manually without the use of any tools, and without any modification to the doorframe.

As disclosed in FIGS. 4A-4F, the apparatus 400 may generally include a main bar 402, a head plate 404, left and right support bars 406 and 408, and a leg tuck bar 450. In some embodiments, the main bar 402 may be extendible and collapsible in order to fit on doorframes of varying widths (e.g., to fit equally well on a door frame with a width between jambs of approximately 24 inches or approximately 36 inches). In some embodiments, the main bar 402 may be approximately 36.6 inches in length, the head plate 404 may be approximately 17.7 inches in length, and the left and right support bars 406 and 408 may be approximately 20.1 inches in length.

The left and right support bars 406 and 408 may be configured to attach to the head plate 404 (at attachment locations 410 and 412) and to the main bar 402 (at attachment locations 414 and 416) in order to connect the head plate 404 to the main bar 402. Similarly, the leg tuck bar 450 may be configured to attach to the head plate 404 (at attachment location 438) and to the main bar 402 (at attachment location 440). The main bar 402 may include bumpers 418 and 420. The main bar 402 may include hand grips at any of locations 422, 424, 426, and 428. The left support bar 406 may include hand grips at locations 430 and 432. The right support bar 408 may include hand grips at locations 434 and 436. The leg tuck bar 450 may include hand grips at locations 456, 458, 460, and 462.

When mounted in a standard interior doorframe (e.g., the doorframe 200) of a home, the head plate 404 may be configured to be positioned above the head of the doorframe (e.g., configured to rest against the wall above the head of the doorframe and/or to rest against the top of the horizontal casing/trim above the head of the doorframe, potentially with a rubber or plastic coating to avoid marring the wall and/or casing/trim), the bumpers 418 and 420 may be configured to be positioned below the head to either side of the jambs of the doorframe (e.g., configured to rest against the walls and/or vertical casings/trim adjacent the jambs of the doorframe, potentially being made from rubber and/or plastic to avoid marring the walls and/or casings/trim), and portions of the left and right support bars 406 and 408 and the leg tuck bar 450 may be configured to run underneath the head of the doorway and between the jambs of the doorway. When mounted to the doorframe, the main bar 402 may be configured to run approximately parallel to the head of the doorframe, while the leg tuck bar 450 may be configured to run approximately perpendicular to the head of the doorframe, and may be configured to be approximately centrally located between jambs of the doorframe. When mounted to the doorframe, the leg tuck bar 450 may be configured to be employed in performing a leg tuck exercise in the doorway of the doorframe without the jambs of the doorframe impeding the performance of the leg tuck exercise, or other similar exercise, even when the distance between the jambs of the doorway is relatively narrow (e.g., between 24 and 32 inches).

Figure 4G:
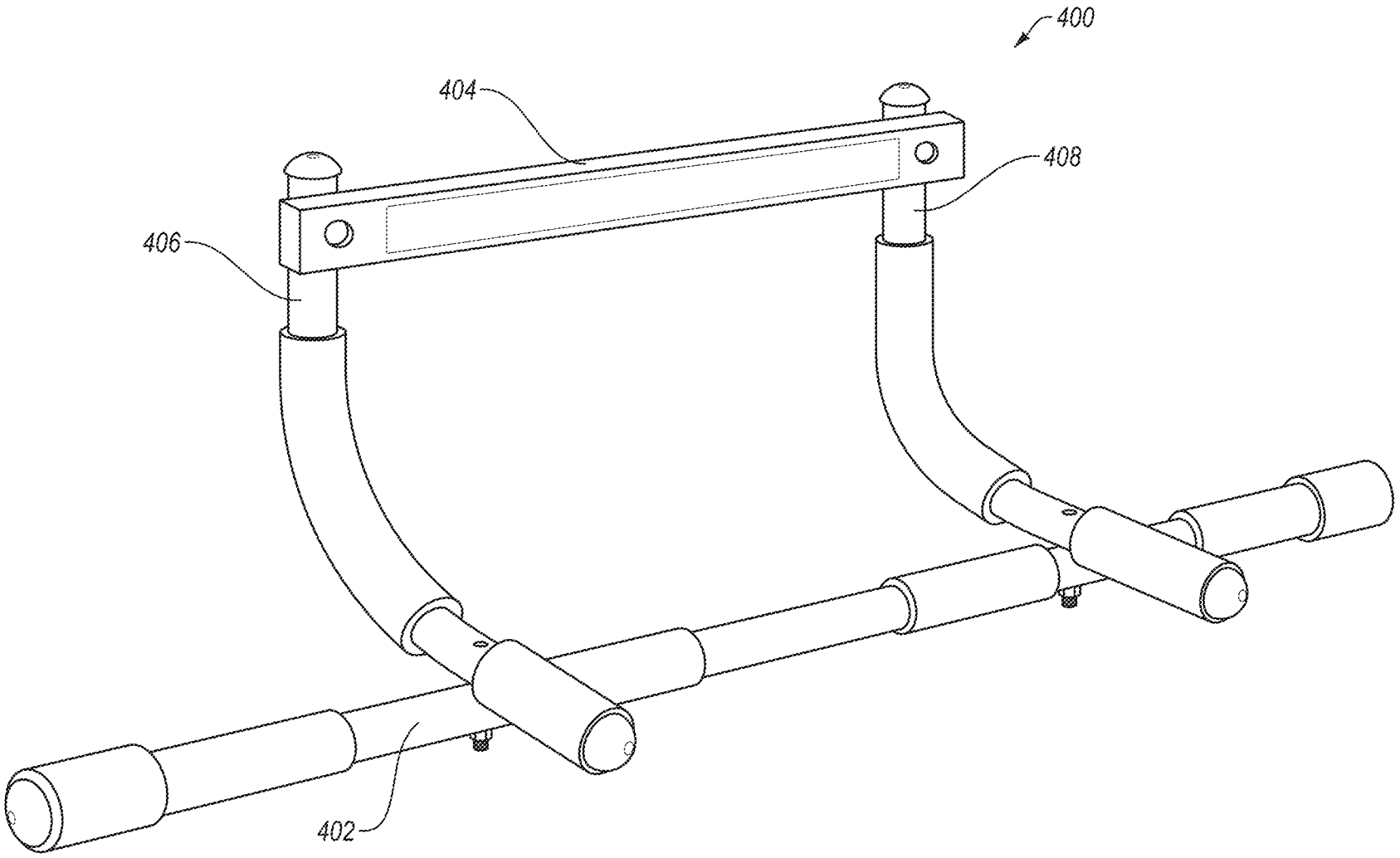
FIG. 4G illustrates a perspective view of the first doorframe mountable exercise apparatus of FIG. 4A having the leg tuck bar removed.
Figure 4H:
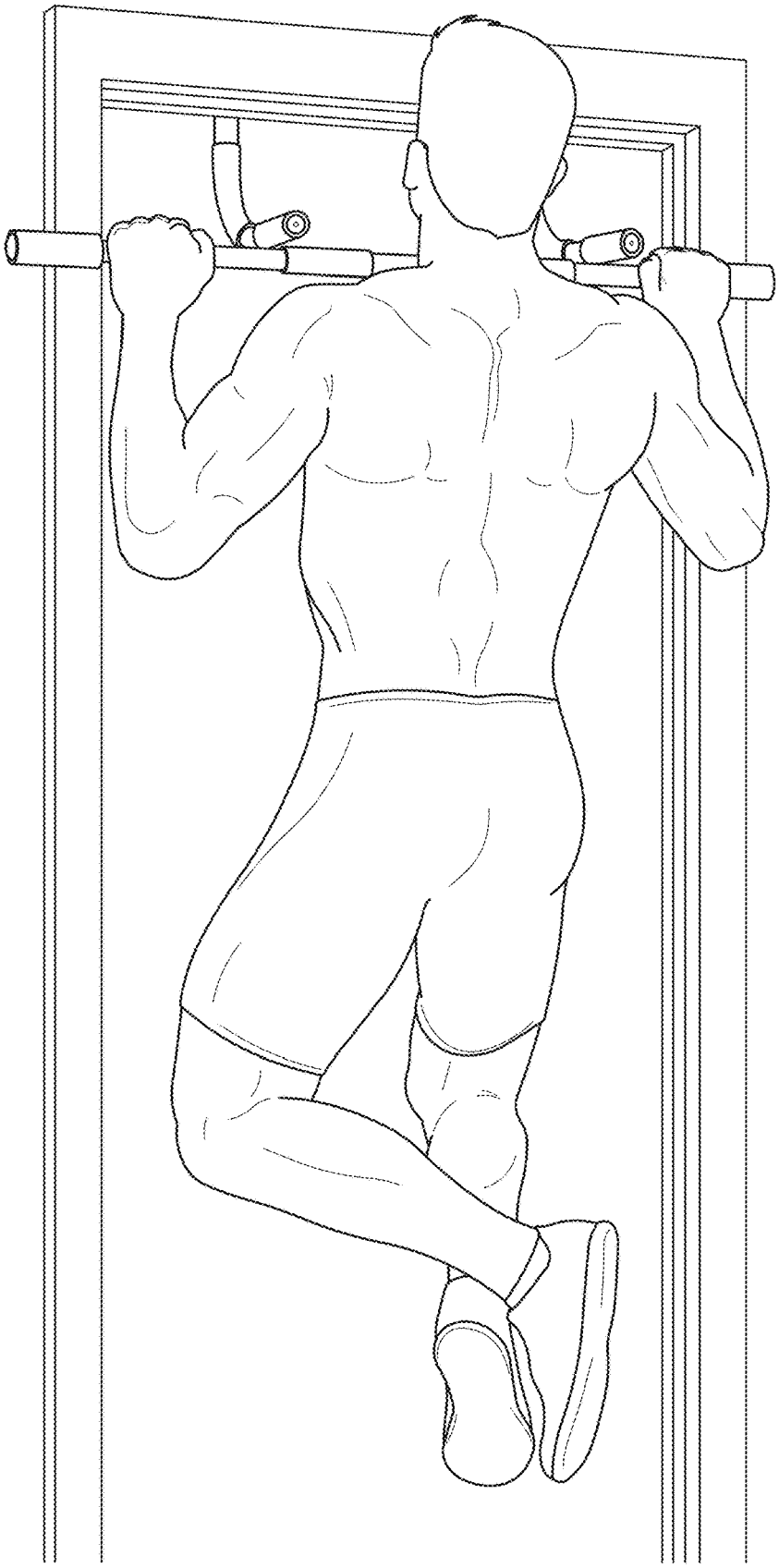
FIGS. 4H-4K illustrate the performance of a pull up exercise, a sit up exercise, a push up exercise, and a triceps dips exercise, respectively, performed on the first doorframe mountable exercise apparatus of FIG. 4A having the leg tuck bar removed.
Figure 4I:
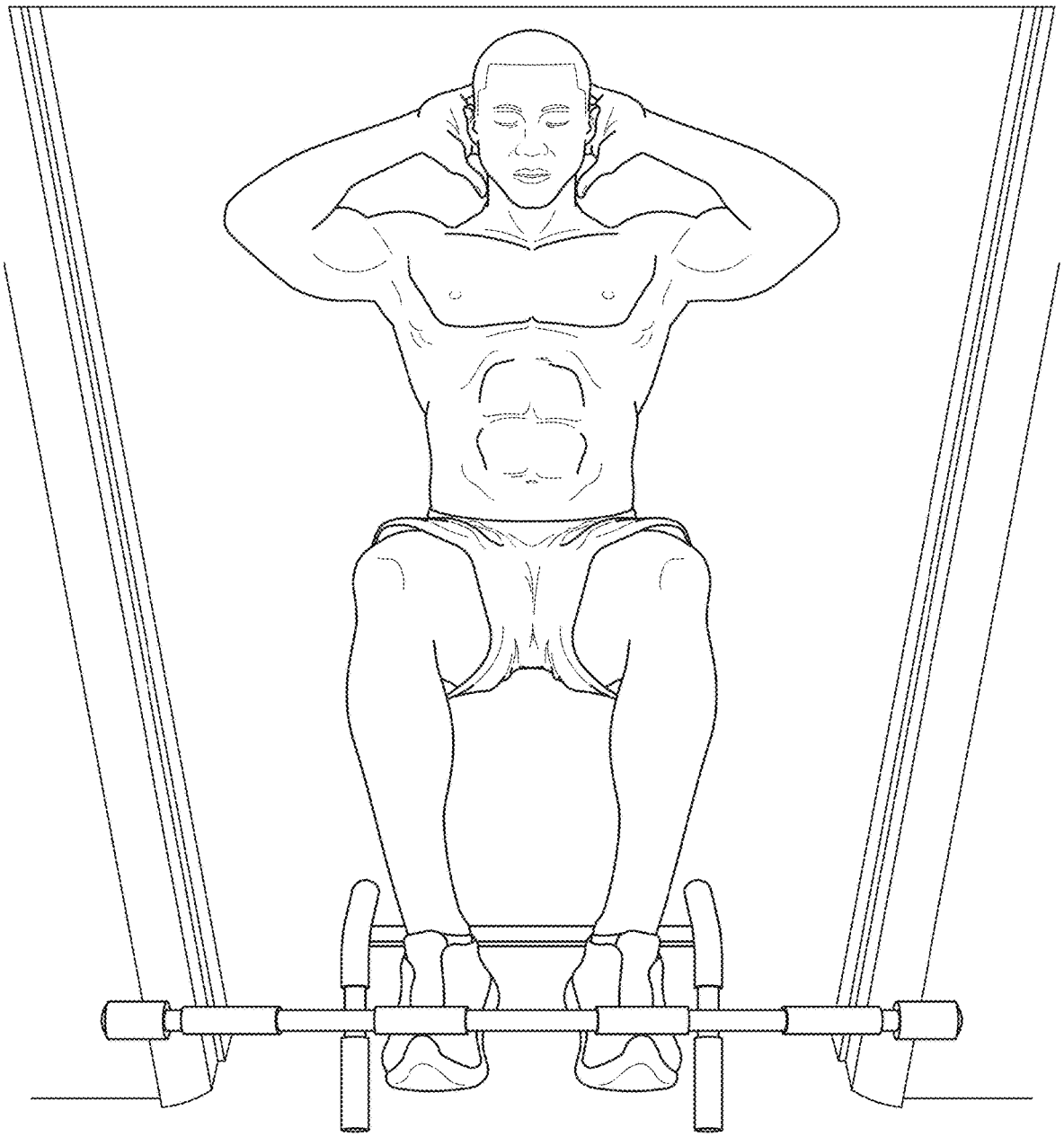
Figure 4J:
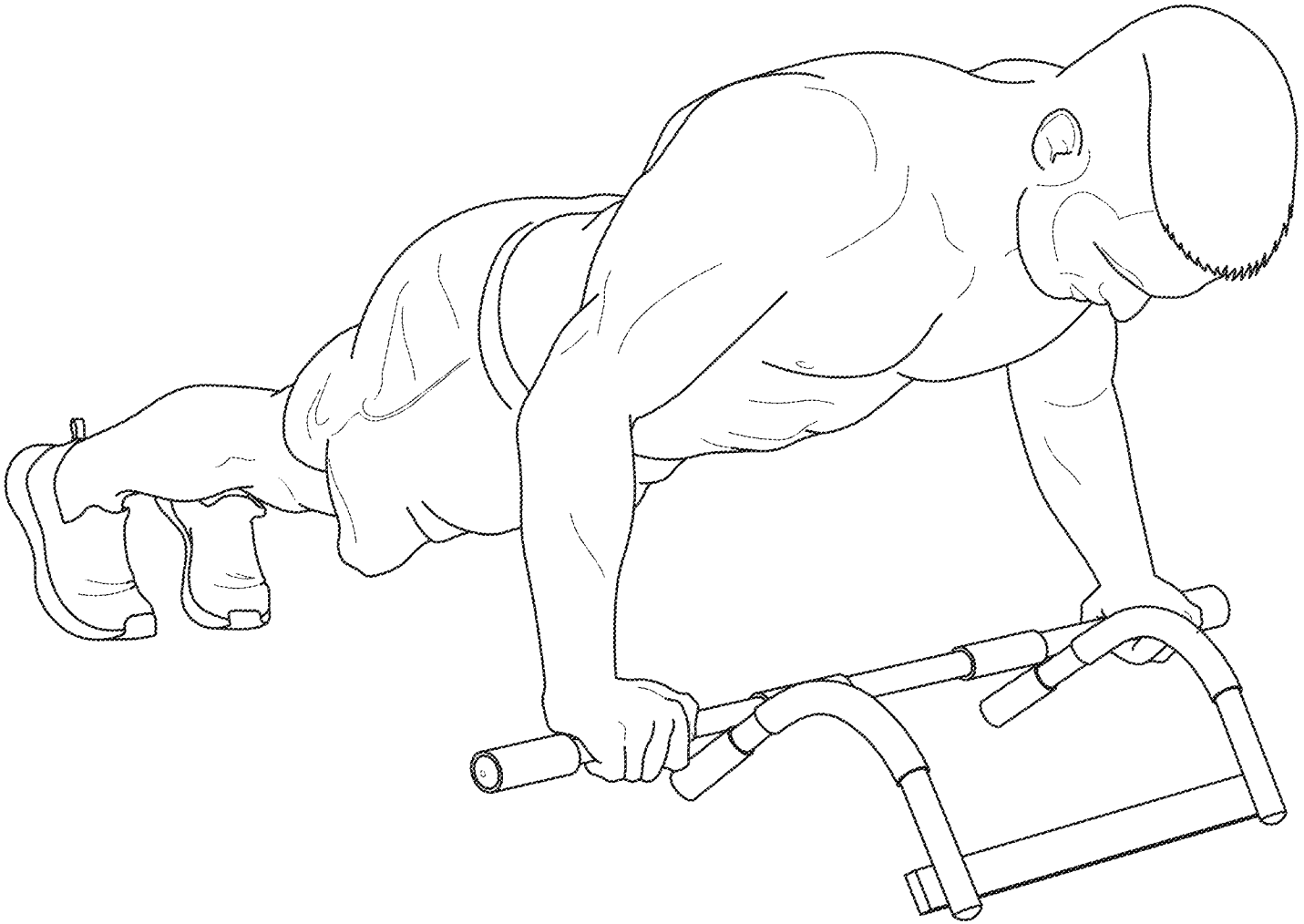
Figure 4K:
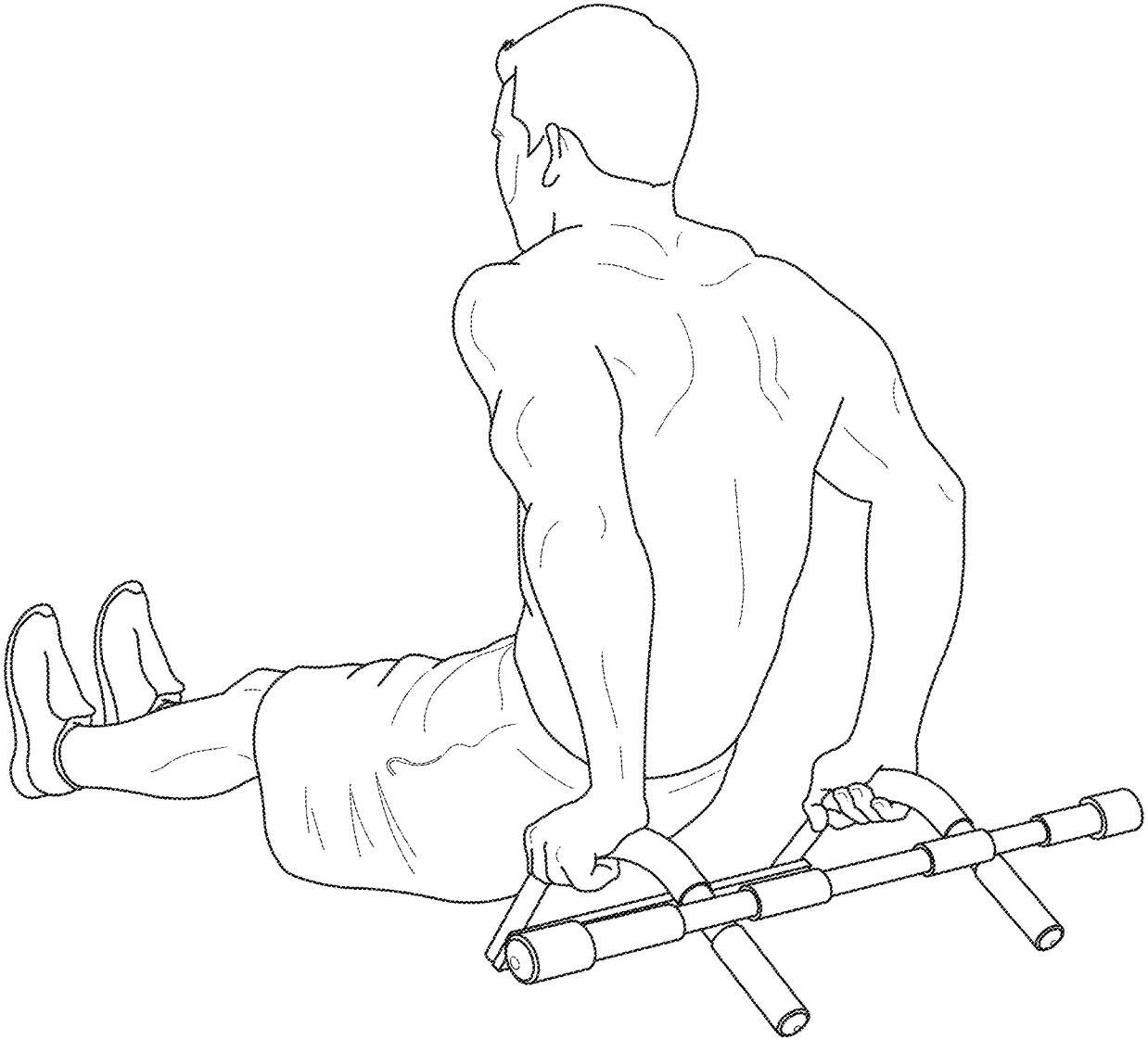

FIG. 4G illustrates a perspective view of the first doorframe mountable exercise apparatus 400 of FIG. 4A having the leg tuck bar 450 removed. As disclosed in a comparison of FIGS. 4A and 4G, the apparatus 400 may be configured such that the leg tuck bar 450 is detachable from the apparatus 400. In some embodiments, the leg tuck bar 450 may be manually attached to, and manually detached from, the head plate 404 (at the attachment location 438) and the main bar 402 (at the attachment location 440) without using any tool.

FIGS. 4H-4K illustrate the performance of a pull up exercise, a sit up exercise, a push up exercise, and a triceps dips exercise, respectively, performed on the first doorframe mountable exercise apparatus 400 of FIG. 4A having the leg tuck bar 450 removed. As disclosed in a comparison of FIGS. 4A, 4G, and 4H, while the leg tuck bar 450 is detached from the apparatus 400, the apparatus 400 may be employed in performing chin up exercises and pull up exercises, or other similar exercise, without the leg tuck bar 450 impeding the user (e.g., without the leg tuck bar 450 getting in the way of the user's head, neck, and upper torso). As disclosed in a comparison of FIGS. 4A, 4G, and 4I-4K, while the leg tuck bar 450 is detached from the apparatus 400, the apparatus 400 may be employed in performing a sit up exercise, a push up exercise, and a triceps dips exercise without the leg tuck bar 450 impeding the apparatus 400 from resting securely against the floor.

Figure 5A:
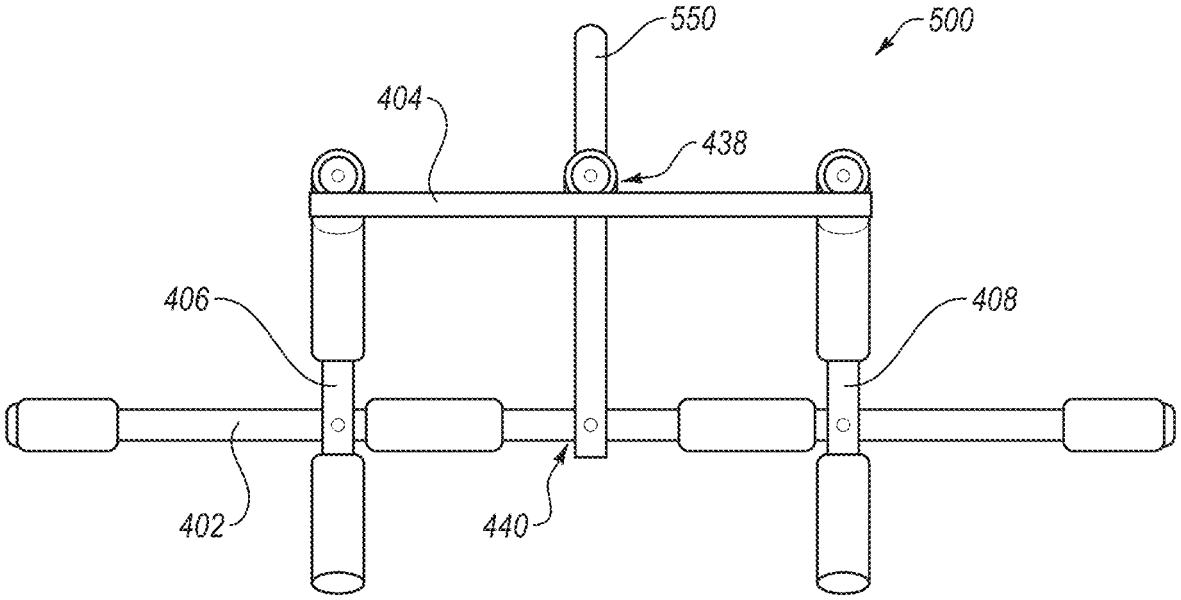
FIG. 5A is a top plan view of a second doorframe mountable exercise apparatus having a leg tuck bar.
Figure 5B:
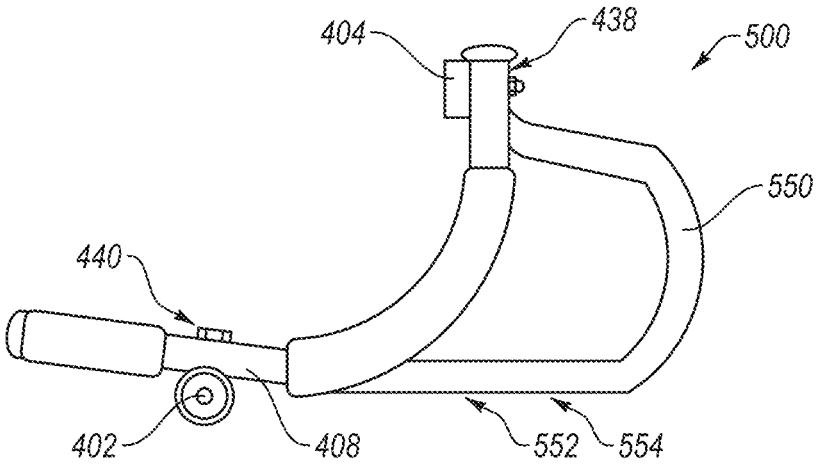
FIG. 5B is a right side elevational view of the second doorframe mountable exercise apparatus having a leg tuck bar of FIG. 5A.

FIGS. 5A and 5B are a top plan view and a right side elevational view of a second doorframe mountable exercise apparatus 500 having a leg tuck bar 550. The apparatus 500 is similar to the apparatus 400. Therefore, only a few of the differences between the apparatus 500 and the apparatus 400 will be discussed herein.

As disclosed in FIGS. 5A-5B, the leg tuck bar 550 may be configured to attach to the head plate 404 (at attachment location 438) and to the main bar 402 (at attachment location 440). The leg tuck bar may include hand grips at locations 552 and 554. Unlike the leg tuck bar 450, the leg tuck bar 550 may only include hand grips between the attachment location 438 and the attachment location 440. When mounted in a standard interior doorframe (e.g., the doorframe 200) of a home, the leg tuck bar 550 may be configured to run approximately perpendicular to the head of the doorframe, and may be configured to be approximately centrally located between jambs of the doorframe, and may be employed in performing a leg tuck exercise in the doorway of the doorframe without the jambs of the doorframe impeding the performance of the leg tuck exercise, or other similar exercise, even when the distance between the jambs of the doorway is relatively narrow (e.g., between 24 and 32 inches).

Figure 5C:
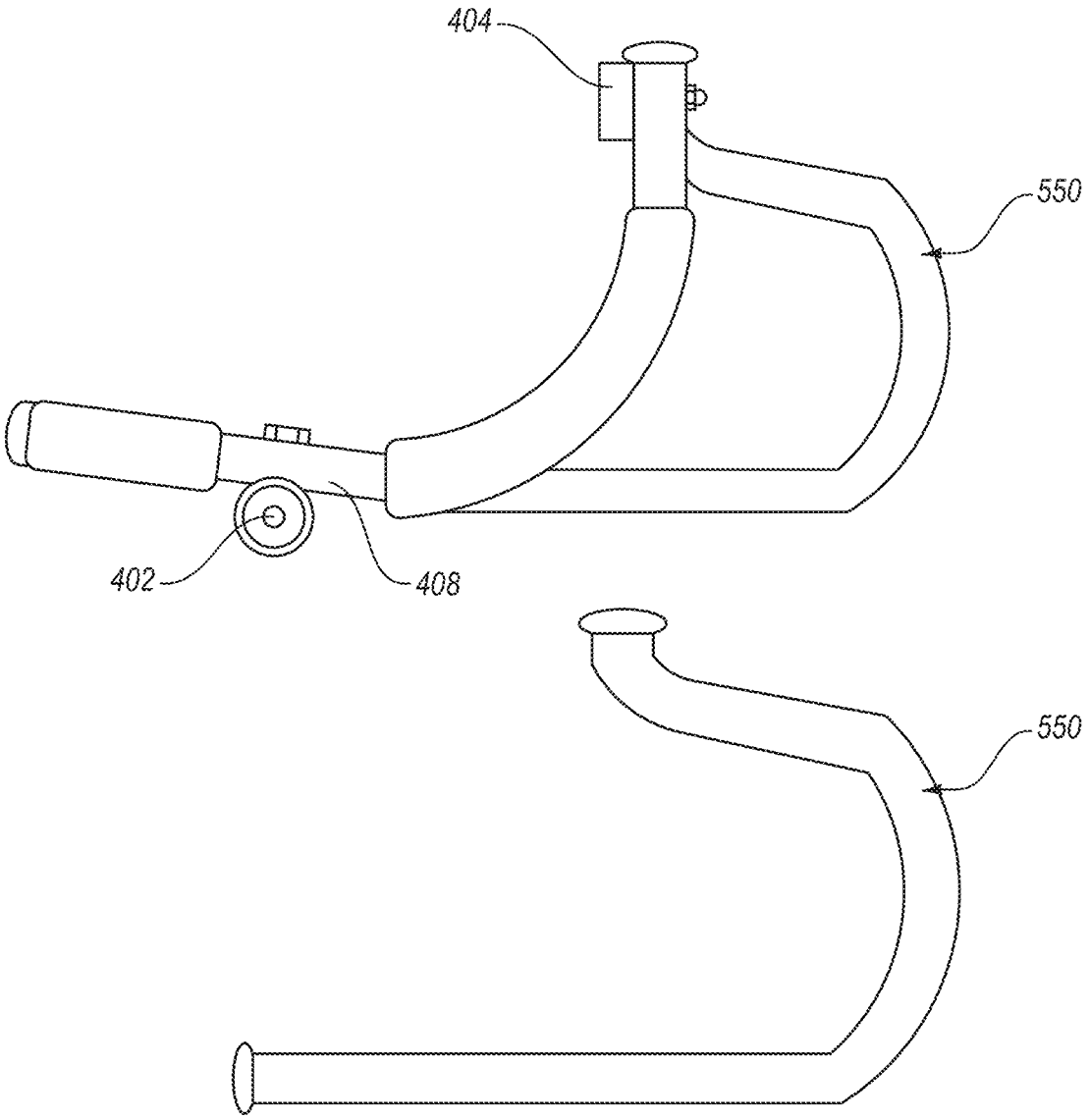
FIG. 5C is a right side elevational view of the second doorframe mountable exercise apparatus of FIG. 5B with the leg tuck bar detached.

FIG. 5C is a right side elevational view of the second doorframe mountable exercise apparatus 500 of FIG. 5A with the leg tuck bar 550 detached. As disclosed in a comparison of FIGS. 5B and 5C, the apparatus 500 may be configured such that the leg tuck bar 550 is detachable from the apparatus 500. In some embodiments, the leg tuck bar 550 may be manually attached to, and manually detached from, the head plate 404 (at the attachment location 438) and the main bar 402 (at the attachment location 440) without using any tool.

Figure 6:
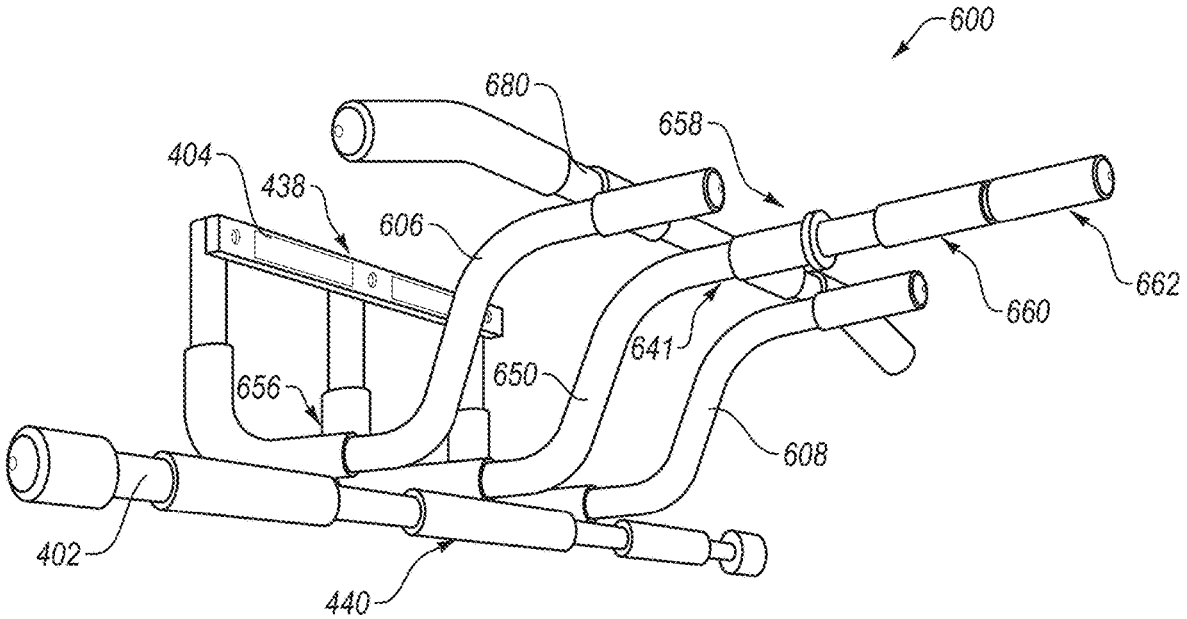
FIG. 6 illustrates a perspective view of a third doorframe mountable exercise apparatus having a leg tuck bar.

FIG. 6 illustrates a perspective view of a third doorframe mountable exercise apparatus 600 having a leg tuck bar 650. The apparatus 600 is similar to the apparatus 400. Therefore, only a few of the differences between the apparatus 600 and the apparatus 400 will be discussed herein.

As disclosed in FIG. 6, the left and right support bars 606 and 608 and the leg tuck bar 650 may curve upwards outward from the attachment locations with the main bar, and then may level off where a second main bar 680 is attached to the left and right support bars 606 and 608 and the leg tuck bar 650. The second main bar 680 may include hand grips at various locations. Further, the leg tuck bar 650 may be configured to attach to the head plate 404 (at attachment location 438), to the main bar 402 (at attachment location 440), and to the second main bar 680 (at attachment location 641) and may include hand grips at locations 656, 658, 660, and 662.

When mounted in a standard interior doorframe (e.g., the doorframe 200) of a home, the leg tuck bar 650 may be configured to run approximately perpendicular to the head of the doorframe, and may be configured to be approximately centrally located between jambs of the doorframe, and may be employed in performing a leg tuck exercise in the doorway of the doorframe without the jambs of the doorframe impeding the performance of the leg tuck exercise, or other similar exercise, even when the distance between the jambs of the doorway is relatively narrow (e.g., between 24 and 32 inches).

Further, the apparatus 600 may be configured such that the leg tuck bar 650 is detachable from the apparatus 600. In some embodiments, the leg tuck bar 650 may be manually attached to, and manually detached from, the head plate 404 (at the attachment location 438), the main bar 402 (at the attachment location 440), and the second main bar 680 (at attachment location 641) without using any tool.

Figure 7:
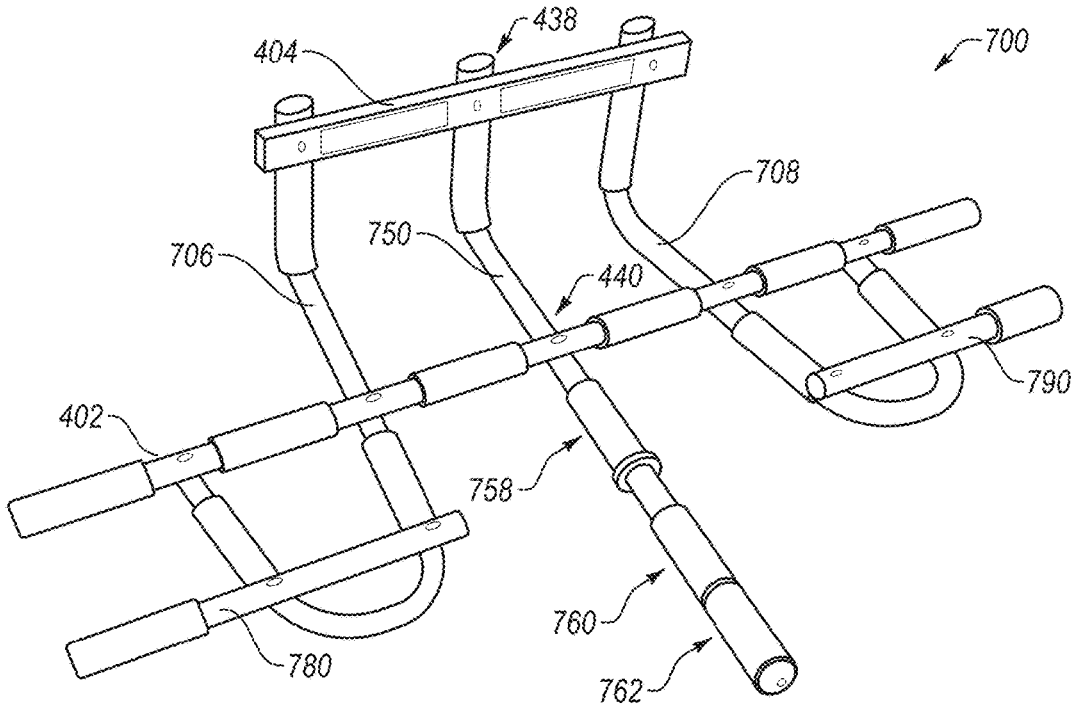
FIG. 7 illustrates a perspective view of a fourth doorframe mountable exercise apparatus having a leg tuck bar.

FIG. 7 illustrates a perspective view of a fourth doorframe mountable exercise apparatus 700 having a leg tuck bar 750. The apparatus 700 is similar to the apparatus 400. Therefore, only a few of the differences between the apparatus 700 and the apparatus 400 will be discussed herein.

As disclosed in FIG. 7, the left and right support bars 706 and 708 may curve backwards in a U-shape outward from the attachment locations with the main bar 402, and then may each attach at an additional attachment location to the main bar 402. Further, second and third main bars 780 and 790 may be attached to the U-shaped portions of the left and right support bars 706 and 708. The second and third main bars 780 and 790 may include hand grips at various locations. Further, the leg tuck bar 550 may be configured to attach to the head plate 404 (at attachment location 438) and to the main bar 402 (at attachment location 440), and may include hand grips at locations 758, 760, and 762.

When mounted in a standard interior doorframe (e.g., the doorframe 200) of a home, the leg tuck bar 750 may be configured to run approximately perpendicular to the head of the doorframe, and may be configured to be approximately centrally located between jambs of the doorframe, and may be employed in performing a leg tuck exercise in the doorway of the doorframe without the jambs of the doorframe impeding the performance of the leg tuck exercise, or other similar exercise, even when the distance between the jambs of the doorway is relatively narrow (e.g., between 24 and 32 inches).

Further, the apparatus 700 may be configured such that the leg tuck bar 750 is detachable from the apparatus 700. In some embodiments, the leg tuck bar 750 may be manually attached to, and manually detached from, the head plate 404 (at the attachment location 438) and the main bar 402 (at the attachment location 440) without using any tool.

Figure 8:
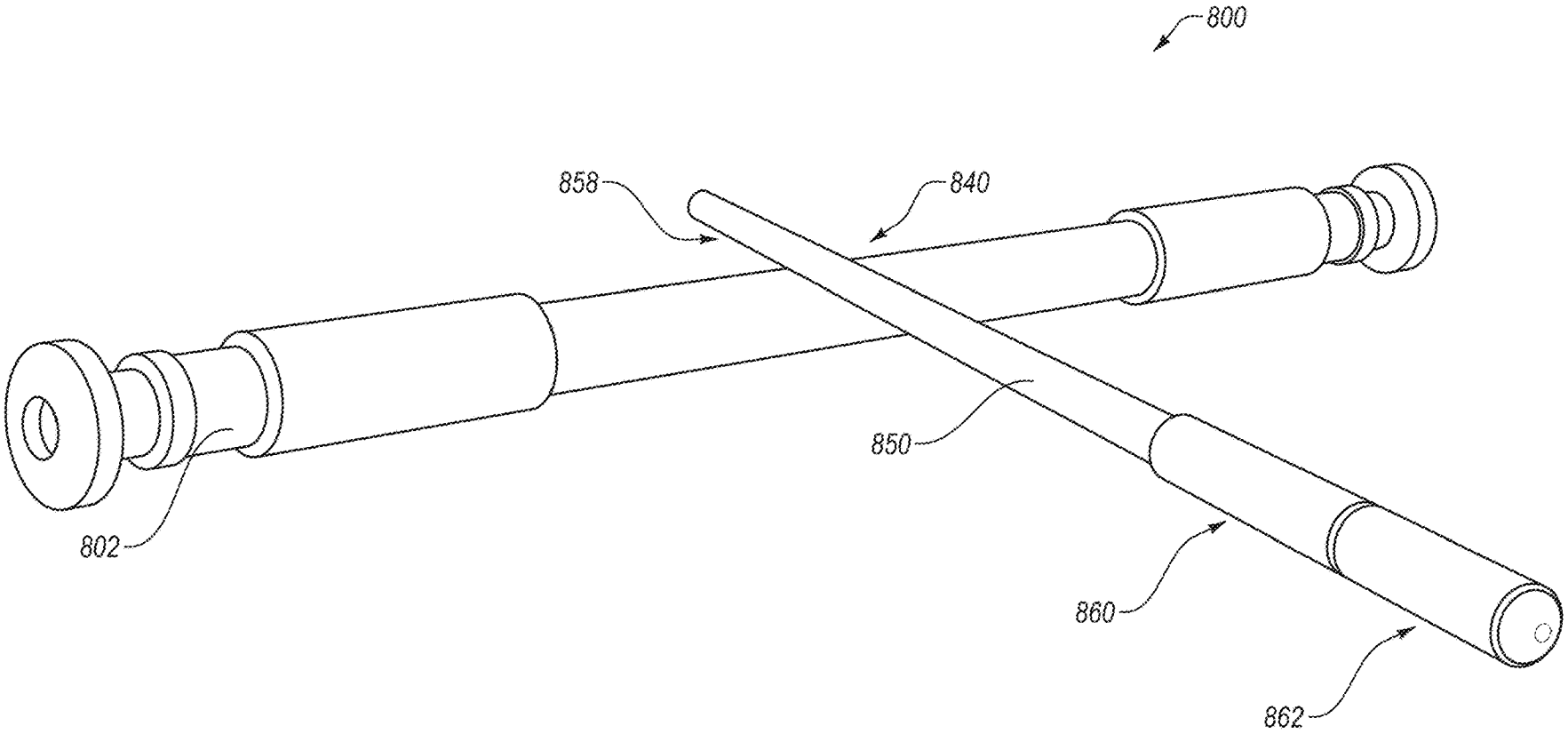
FIG. 8 illustrates a perspective view of a fifth doorframe mountable exercise apparatus having a leg tuck bar.

FIG. 8 illustrates a perspective view of a fifth doorframe mountable exercise apparatus 800 having a leg tuck bar 850. As disclosed in FIG. 8, the apparatus 800 includes a main bar 802 and a leg tuck bar 850. The main bar 802 may include hand grips at various locations. The leg tuck bar 850 may be configured to attach to the main bar 802 (at attachment location 840), and may include hand grips at locations 858, 860, and 862.

When mounted in a standard interior doorframe (e.g., the doorframe 200) of a home, the main bar 802 may be mounted directly to the jambs of the doorframe (e.g., via pressure from the expansion of the main bar 802, and potentially using brackets attached to the jambs that prevent the main bar 802 from rotating). Further, when the apparatus 800 is mounted to the doorframe, the leg tuck bar 850 may be configured to run approximately perpendicular to the head of the doorframe, and may be configured to be approximately centrally located between jambs of the doorframe, and may be employed in performing a leg tuck exercise in the doorway of the doorframe without the jambs of the doorframe impeding the performance of the leg tuck exercise, or other similar exercise, even when the distance between the jambs of the doorway is relatively narrow (e.g., between 24 and 32 inches).

Further, the apparatus 800 may be configured such that the leg tuck bar 850 is detachable from the apparatus 800. In some embodiments, the leg tuck bar 850 may be manually attached to, and manually detached from, the main bar 802 (at the attachment location 840) without using any tool.

Each attachment at each attachment location between two components disclosed herein may be accomplished in a variety of permanent or non-permanent ways. For example, two components may be attached using a bolt and a nut. The hole through the two components through which the bolt extends may be recessed on one or both sides so that the head of the bolt and/or the nut is also recessed into the components. The recess may further match the shape of the head of the bolt and/or the nut to prevent the head of the bolt and/or the nut from turning when positioned in the recess. The nut may be a lock nut and/or may be employed in connection with a lock washer to avoid the nut from inadvertently becoming loose. Further, the nut and/or the head of the bolt may be attached to, or incorporated into, a handle such as a quick-release lever or a quick-release pin or a knob so that the bolt and nut can be tightened and loosed manually without the use of any tool. Further, various washers or gaskets or spacers may be employed, such as between the components or between the head of the bolt and/or the nut, to protect the components, such as rubber or plastic or metal washers or gaskets or spacers. In another example, two components may be attached using a quick-release pin. Any other non-permanent or permanent fastener or means for fastening (such as welding, adhesives, rivets, metal brackets, silicone or rubber brackets, and other mechanical fasteners) may be employed.

Further, each of the leg tuck bars disclosed herein may be designed and sold as an after-market add-on to each of the doorframe mountable exercise apparatuses disclosed herein. For example, in some embodiments, any of the leg tuck bars disclosed herein (e.g., any the leg tuck bars 450, 550, 650, 750, or 850) may be sold separately from any doorframe mountable exercise apparatus. Further, in some embodiments, any of the leg tuck bars disclosed herein may be sold in a kit that includes bolts, nuts, and instructions for installing the leg tuck bars on each of the doorframe mountable exercise apparatuses disclosed herein (e.g., by drilling holes in the head plate and the main bar, positioning the leg tuck bar over the holes, and then bolting the leg tuck bar to the head plate and the main bar). In some embodiments, the leg tuck bar may be sold with a kit that includes rigid or flexible fasteners (e.g. brackets, bands, etc.) that may enable the leg tuck bar to be attached to, and detached from, a doorframe mountable exercise apparatus without any modification of the doorframe mountable exercise apparatuses (e.g., no holes must be drilled in the doorframe mountable exercise apparatus), such as by wrapping the rigid or flexible fasteners around, or clamping the rigid or flexible fasteners to, the head plate and the main bar, without modifying the head plate and the main bar. As disclosed herein, these after-market installations of a leg tuck bar may be temporary such that the leg tuck bar may be easily attached and detached, in some cases manually without any tools.

Also, each of the leg tuck bars disclosed herein may be designed as two or more components parts. For example, each of the leg tuck bars disclosed herein may be configured as two components, with the first component configured to be attached to the head plate and the main bar, and the second component configured to be attached to the first component at or near the attachment location of the first component to the main bar (or of the second main bar in the case of embodiments such as those in FIG. 6), such as by fitting into the first component and being locked in place by a quick-release pin, in order to perform leg tuck exercises by grasping the second component. In this example, when the second component is detached from the first component, the main bar can then be used for pull up and chin up exercises without the second component getting in the way of the user's head, neck, and upper torso.

Further, each of the leg tuck bars disclosed herein may be designed to be mounted on an interior or exterior doorframe having a width between jambs that is less than approximately 24 inches (e.g., approximately 20 inches) or greater than approximately 32 inches (e.g., approximately 36 inches).

Also, each of the "hand grips" disclosed herein may be configured to be long enough to be comfortably and securely grasped by at least an average adult human hand while performing the exercises disclosed herein. In some embodiments, each of the hand grips disclosed herein may have a length between approximately 3 inches and approximately 5 inches. In some embodiments, each of the hand grips disclosed herein may have a length between approximately 3.5 inches and approximately 5 inches. In some embodiments, each of the hand grips disclosed herein may have a length between approximately 4 inches and approximately 5 inches. In some embodiments, each of the hand grips disclosed herein may have a length between approximately 4 inches and approximately 5.5 inches. Further, each of the hand grips disclosed herein may have a diameter that is small enough to be securely grasped by an average adult human hand, but large enough to be comfortable when being grasped by an average adult human hand. In some embodiments, a hand grip may be on the bar itself, or some textured portion or molded portion of the bar itself to improve comfort and/or grip. In some embodiments, a hand grip may include a covering on the bar, such as a foam and/or plastic covering on the bar, to improve comfort and/or grip. In some embodiments, each of the hand grips disclosed herein may have a diameter of approximately 1 inch to approximately 2 inches. In some embodiments, each of the hand grips disclosed herein may have a diameter of approximately 1 inch to approximately 1.25 inches. In some embodiments, a hand grip having a diameter less than approximately 0.5 inches would be too painful to grip for an average adult human hand while performing the chin up, pull up, and leg tuck exercises disclosed herein (e.g., because the hand grip would dig into the hand in a painful way).

Any of the example components disclosed herein in connection with the apparatus may be moved from generally mirrored left-and-right positions to other positions, such as non-mirrored positions or center positions. For example, two or more support bars may function similarly to each of the left and right support bars disclosed in the drawings. Therefore, the terms "left" and "right" as disclosed herein are for convenience only and are not intended to dictate generally mirrored left-and-right positions of components.

In accordance with common practice, the various features illustrated in the drawings may not be drawn to scale. The illustrations presented in the present disclosure are not meant to be actual views of any particular apparatus (e.g., device, system, etc.) or method, but are merely example representations that are employed to describe various embodiments of the disclosure. Accordingly, the dimensions of the various features may be arbitrarily expanded or reduced for clarity. In addition, some of the drawings may be simplified for clarity. Thus, the drawings may not depict all of the components of a given apparatus (e.g., device) or all operations of a particular method.

Terms used herein and especially in the appended claims (e.g., bodies of the appended claims) are generally intended as "open" terms (e.g., the term "including" should be interpreted as "including, but not limited to," the term "having" should be interpreted as "having at least," the term "includes" should be interpreted as "includes, but is not limited to," etc.).

Additionally, if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations.

In addition, even if a specific number of an introduced claim recitation is explicitly recited, it is understood that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." or "one or more of A, B, and C, etc." is used, in general such a construction is intended to include A alone, B alone, C alone, A and B together, A and C together, B and C together, or A, B, and C together, etc. For example, the use of the term "and/or" is intended to be construed in this manner.

Further, any disjunctive word or phrase presenting two or more alternative terms, whether in the summary, detailed description, claims, or drawings, should be understood to contemplate the possibilities of including one of the terms, either of the terms, or both terms. For example, the phrase "A or B" should be understood to include the possibilities of "A" or "B" or "A and B."

Additionally, the use of the terms "first," "second," "third," etc., are not necessarily used herein to connote a specific order or number of elements. Generally, the terms "first," "second," "third," etc., are used to distinguish between different elements as generic identifiers. Absence a showing that the terms "first," "second," "third," etc., connote a specific order, these terms should not be understood to connote a specific order. Furthermore, absence a showing that the terms first," "second," "third," etc., connote a specific number of elements, these terms should not be understood to connote a specific number of elements. For example, a first widget may be described as having a first side and a second widget may be described as having a second side. The use of the term "second side" with respect to the second widget may be to distinguish such side of the second widget from the "first side" of the first widget and not to connote that the second widget has two sides.

As used in the specification and the claims, the term "approximately" shall mean that the value is within 10 percent or 10 degrees of the stated value, unless otherwise specified. For example, the term "approximately 10 inches" refers to a value of between 9 inches and 11 inches. In another example, the term "approximately centrally located between jambs of a doorframe spaced 30 inches apart" refers to a position plus or minus 3 inches from the center between the jambs of the doorframe. In another example, the term "approximately perpendicular to" refers to an orientation between 80 degrees and 100 degrees. In another example, the term "approximately parallel to" refers to an orientation between 350 degrees and 10 degrees.

The foregoing description, for purpose of explanation, has been described with reference to specific embodiments. However, the illustrative discussions above are not intended to be exhaustive or to limit the invention as claimed to the precise forms disclosed. Many modifications and variations are possible in view of the above teachings. The embodiments were chosen and described to explain practical applications, to thereby enable others skilled in the art to utilize the invention as claimed and various embodiments with various modifications as may be suited to the particular use contemplated.

The invention claimed is:

1. A doorframe mountable exercise apparatus comprising:

a head plate configured to be mounted to a doorframe above a head of the doorframe;

a main bar configured to be mounted to the doorframe below the head of the doorframe;

first and second support bars configured to attach to the head plate and to the main bar to connect the head plate to the main bar; and a leg tuck bar configured to attach to the head plate at a first attachment location and to the main bar at a second attachment location to connect the head plate to the main bar and to be approximately centrally located between jambs of the doorframe.

2. The doorframe mountable exercise apparatus of claim 1, wherein:

the leg tuck bar includes first and second hand grip locations; and the second attachment location is located between the first attachment location and the first and second hand grip locations.

3. The doorframe mountable exercise apparatus of claim 2, wherein:

the leg tuck bar is further configured to attach to the main bar at the second attachment location with the leg tuck bar above the main bar.

4. The doorframe mountable exercise apparatus of claim 3, wherein:

the leg tuck bar is further configured to attach to the main bar at the second attachment location with the first and second hand grip locations above the main bar.

5. The doorframe mountable exercise apparatus of claim 3, wherein:

the leg tuck bar further includes a first component configured to attach to the head plate at the first attachment location and to the main bar at the second attachment location; and the leg tuck bar further includes a second component configured to attach to, and detach from, the first component near the second attachment location, the second component including the first and second hand grip locations.

6. The doorframe mountable exercise apparatus of claim 5, wherein:

the second component is configured to attach to, and detach from, the first component with the first and second hand grip locations above the main bar.

7. The doorframe mountable exercise apparatus of claim 2, wherein:

the main bar includes third and fourth hand grip locations; and the second attachment location is located between the third hand grip location and the fourth hand grip location.

8. The doorframe mountable exercise apparatus of claim 7, wherein:

the leg tuck bar is further configured to attach the main bar at the second attachment location such that the first and second hand grip locations run approximately perpendicular to the third and fourth hand grip locations.

9. The doorframe mountable exercise apparatus of claim 2, wherein:

the first support bar includes a third hand grip location;

the second support bar includes a fourth hand grip location; and the first and second support bars and the leg tuck bar are configured to attach to the main bar such that the first hand grip location is between the third hand grip location and the fourth hand grip location.

10. The doorframe mountable exercise apparatus of claim 9, wherein:

the leg tuck bar is further configured to attach the main bar at the second attachment location such that the first and second hand grip locations run approximately parallel to the third and fourth hand grip locations.

11. The doorframe mountable exercise apparatus of claim 1, wherein:

the leg tuck bar is further configured to be manually attached to, and manually detached from, the head plate at the first attachment location and the main bar at the second attachment location without using any tool.

12. The doorframe mountable exercise apparatus of claim 1, wherein:

the leg tuck bar is further configured to be employed in performing a leg tuck exercise in a doorway of the doorframe without the jambs of the doorframe impeding the performance of the leg tuck exercise.

13. A doorframe mountable exercise apparatus comprising:

a head plate configured to be mounted to a doorframe above a head of the doorframe;

a main bar configured to be mounted to the doorframe below the head of the doorframe;

first and second support bars configured to attach to the head plate and to the main bar to connect the head plate to the main bar by running underneath the head of the doorframe and between jambs of the doorframe; and a leg tuck bar including first and second hand grip locations, the leg tuck bar configured to attach to the head plate at a first attachment location and to the main bar at a second attachment location to connect the head plate to the main bar by running underneath the head of the doorframe and between the jambs of the doorframe, to run approximately perpendicular to the head of the doorframe, and to be approximately centrally located between the jambs of the doorframe.

14. The doorframe mountable exercise apparatus of claim 13, wherein:

the second attachment location is located between the first attachment location and the first and second hand grip locations; and the leg tuck bar is further configured to attach to the main bar at the second attachment location with the leg tuck bar above the main bar.

15. The doorframe mountable exercise apparatus of claim 14, wherein:

the leg tuck bar is further configured to attach to the main bar at the second attachment location with the first and second hand grip locations above the main bar.

16. The doorframe mountable exercise apparatus of claim 15, wherein:

the leg tuck bar further includes a first component configured to attach to the head plate at the first attachment location and to the main bar at the second attachment location; and the leg tuck bar further includes a second component configured to attach to, and detach from, the first component near the second attachment location, the second component including the first and second hand grip locations.

17. The doorframe mountable exercise apparatus of claim 13, wherein:

the main bar includes third and fourth hand grip locations;

the second attachment location is located between the third hand grip location and the fourth hand grip location; and the leg tuck bar is further configured to attach the main bar at the second attachment location with the first and second hand grip locations running approximately perpendicular to the third and fourth hand grip locations.

18. The doorframe mountable exercise apparatus of claim 13, wherein:

the first support bar includes a third hand grip location;

the second support bar includes a fourth hand grip location;

the first and second support bars and the leg tuck bar are further configured to attach to the main bar with the first hand grip location being between the third hand grip location and the fourth hand grip location; and the leg tuck bar is further configured to attach the main bar at the second attachment location with the first and second hand grip locations running approximately parallel to the third and fourth hand grip locations.

19. The doorframe mountable exercise apparatus of claim 13, wherein:

the leg tuck bar is further configured to be manually attached to, and manually detached from, the head plate at the first attachment location and the main bar at the second attachment location without using any tool.

20. The doorframe mountable exercise apparatus of claim 13, wherein:

the leg tuck bar is further configured to be employed in performing a leg tuck exercise in a doorway of the doorframe without the jambs of the doorframe impeding the performance of the leg tuck exercise.

* * * * *